United States Patent [19]

Terzian et al.

[11] 4,030,235

[45] June 21, 1977

[54] TOY PLAY KIT

[75] Inventors: Rouben T. Terzian, Chicago; Palmer J. Schoenfield, Evanston; Kathy A. Dunn, Chicago; Wayne A. Kuna, Oak Park, all of Ill.

[73] Assignee: Marvin Glass & Associates, Chicago, Ill.

[22] Filed: Feb. 17, 1976

[21] Appl. No.: 658,701

[52] U.S. Cl. ..... 46/11; 46/116

[51] Int. Cl.[2] ..... A63H 3/00

[58] Field of Search ..... 46/1 R, 11, 12, 116

[56] References Cited

UNITED STATES PATENTS

| | | | |
|---|---|---|---|
| 2,781,611 | 2/1957 | Bills et al. | 46/116 |
| 2,872,753 | 2/1959 | Fenton | 46/12 |
| 2,959,891 | 11/1960 | Barnett et al. | 46/116 |
| 3,858,351 | 1/1975 | Porter | 46/116 |

*Primary Examiner*—Louis G. Mancene

*Assistant Examiner*—Robert F. Cutting

*Attorney, Agent, or Firm*—Mason, Kolehmainen, Rathburn & Wyss

[57] ABSTRACT

A comprehensive play set is provided for use by children in playing animal hospital games. The set includes a case formed of a pair of hingedly connected mating casing portions which can be opened by the child for access to objects or items mounted or stored therein. A hanger device for receiving various toy medical instruments and a toy medicine cabinet for containing such instruments are secured to casing walls inside the casing. A bunk bed is removably hanging having a lip received by an upturned or hook-like flange secured to the inner surface of a wall of one casing half. An assortment of other toy medical items is contained in the case including an operating or examination table, as well as a plurality of figurines to be used by the child as patients.

14 Claims, 5 Drawing Figures

TOY PLAY KIT

BACKGROUND OF THE INVENTION

This invention relates to play sets for children and particularly relates to an animal or pet hospital set for use by a child for entertainment or amusement purposes.

SUMMARY OF THE INVENTION

A child's amusement or entertainment device in the form of a play kit including a carrying case in the shape of a simulated ambulance or other emergency device and having a top handle for convenient transportation by a child. The case comprises mating case halves hingedly connected along a vertical seam line at one end of the case simulating the back of the ambulance. The simulated ambulance has front and rear bumpers and when the case is opened the rear bumper portions on the two casing halves abut each other as stops at full case open position. A fold down flap or platform is provided within one casing half to give additional playing area with the case in open position and with the platform folded down. When the platform is folded up it acts as a partition between the two casing halves to prevent undue shifting and intermixing of objects within the casing halves when the casing is closed and being transported. A lateral bar is fixedly mounted, spaced inwardly from one wall of one of the casing halves, defining pockets for receiving and supporting play medical charts or a clip board or the like in upright position. A plurality of vertically spaced bunkbeds are removably mounted in the other casing half on a wall by a hook flange engaging an outwardly extending lip of a bunkbed with a projecting flange beneath the hook flange engaging the end of the bunkbed below the lip to support the bunkbed in generally horizontal position. Also secured to the inner surface of an end wall at one casing half is a cabinet having a hinged door and in which such items as medicine bottles or like items may be stored. A shelf member also is provided having extended fingers for releasably receiving such items as a syringe and an eye, ear and nose scope. Among various loose items which may be stored within the case are a wheeled cart for play transport of patients and a bandage dispenser from which bandage material can be withdrawn for use in the play treatment of patients. The case interior, with the case open, is generally divided by designation into "Treatment Room" and "Recovery Room" areas. In the "Recovery Room" area an "Emergency" sign is hingedly connected to a casing half adjacent the seam line edge of the casing for movement between an extended position during use of the device and a retracted position within a storage cavity inside the casing half for storage while when the case is closed. Figure toys in the form of various animals are provided for use with the kit to simulate veterinarian medical administration.

While this invention is susceptible of embodiment in many different forms, there is shown in the drawings and will herein be described in detail a specific embodiment and modification thereof, with the understanding that the present disclosure is to be considered as an exemplification of the principles of the invention and is not intended to limit the invention to the embodiment illustrated.

DESCRIPTION OF THE PREFERRED EMBODIMENT

Figure 1:
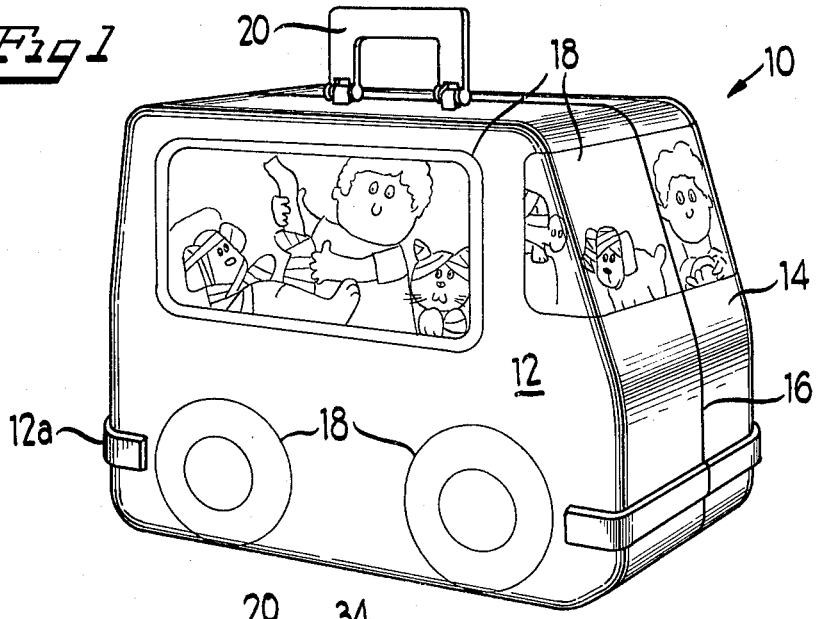
FIG. 1 is a perspective view of an embodiment of the hospital set of this invention with the carrying case portion thereof closed.
Figure 2:
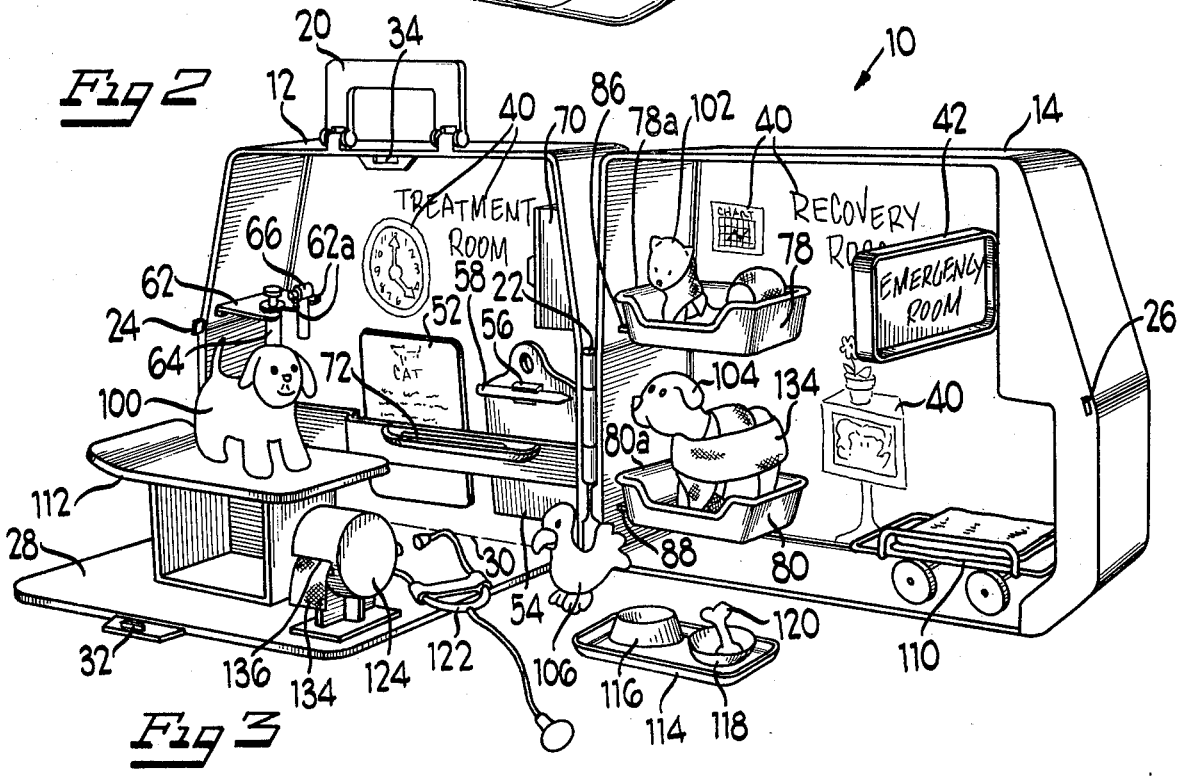
FIG. 2 is a perspective view of the embodiment of FIG. 1 with the carrying case open and with various items and or objects shown in a normal child-play position.

Referring first to FIGS. 1 and 2, the illustrated embodiment of the invention is in the form of a pet hospital set having a case indicated generally by reference numeral 10. Case 10 comprises two casing portions or halves 12 and 14 mateable along a vertical seam at 16. The case 10 has various printed indicia 18 on the outer surface thereof, including indicia of wheels and windows and figures at the windows and is shaped to simulate an ambulance or other emergency vehicle. A handle 20 is provided on the top of case 10 near the seam line 16 so that a child can easily carry the case from place to place in the play of veterinarian hospital games.

The casing halves 12 and 14 are connected by a vertical hinge 22 (FIGS. 2, 4 and 5) for movement between case open and case closed positions. When in case closed position (FIG. 1), a resilient tongue-like snap latch 24 (FIG. 2) at the seam edge of casing half 12 is releasably engaged by a latch receiver 26 at the seam edge of casing half 14 to secure the casing halves 12 and 14 in case closed position.

Figure 4:
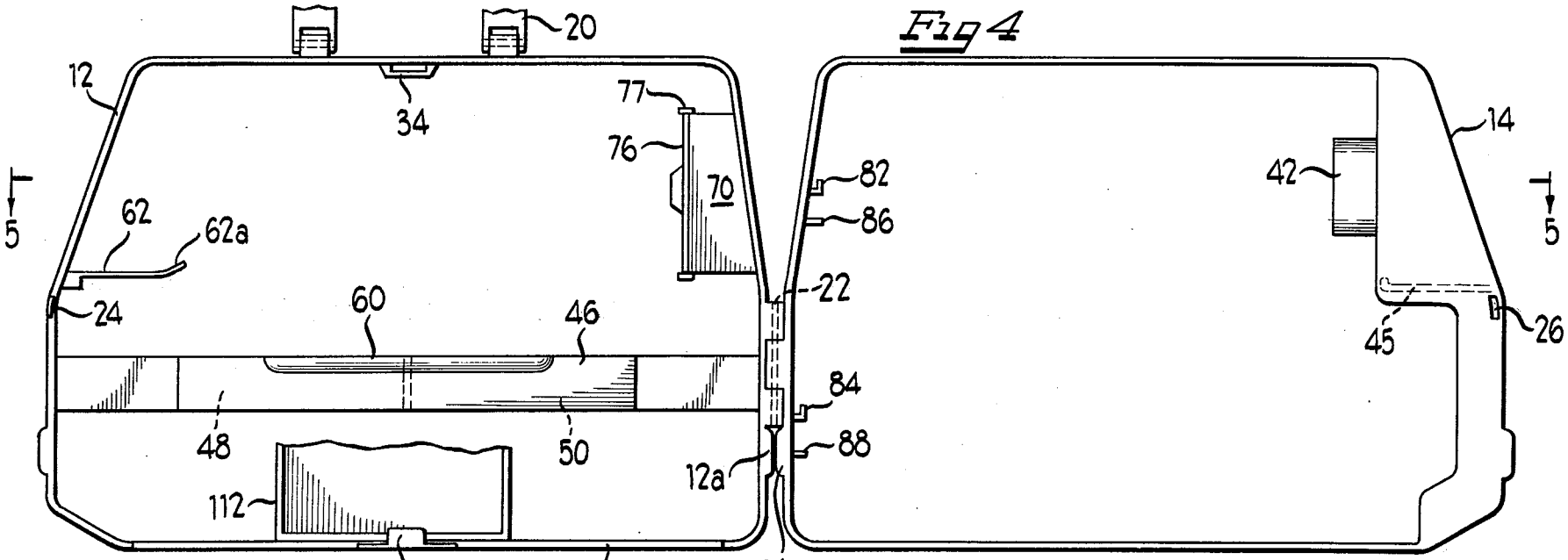
FIG. 4 is a fragmentary elevational view of the case shown in FIGS. 1 and 2 with the case open and showing the interior structure of the casing halves.
Figure 5:
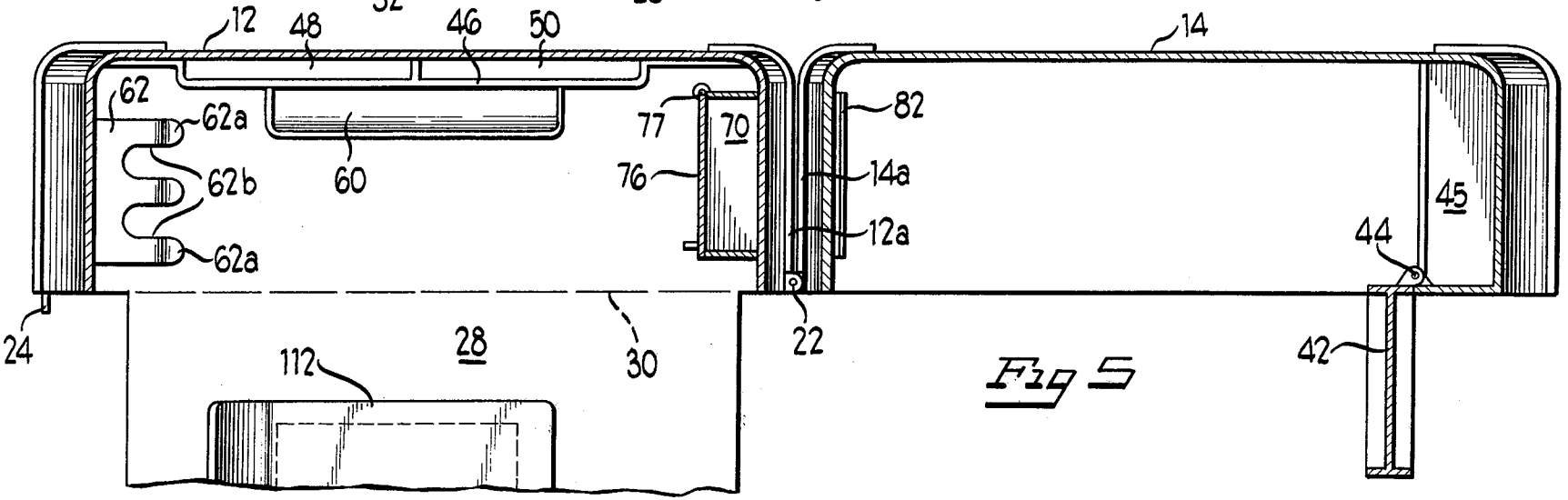
FIG. 5 is a sectional view taken generally along line 5—5 of FIG. 4.

A platform 28 is connected by a crease line or fold hinge at 30 (FIGS. 2 and 5) to the mating or seam line edge of the bottom wall of casing half 12 so that it can be swung from its platform position as shown in FIGS. 2, 4 and 5 to an upright position. With the platform 28 in its upright position a snap latch 32 is received by a latch receiver 34 so that the platform 28 serves as a partition between casing portions 12 and 14 within the case 10. When the case 10 is in full open position, outer rear bumper portions **12*a* and 14*a* (FIGS. 4 and 5) of casing halves 12 and 14 abut each other to provide a stop preventing undue override leverage on hinge 22.**

Referring to FIG. 2, indicia indicated by reference numeral 40, may be printed on the inner surface of the wall of casing halves 12 and 14. For example, a patient progress chart and a TV set are printed in casing half 14 and a clock is printed in casing half 12. Areas of the pet hospital are also indicated by indicia 40 as "Treatment Room" and "Recovery Room".

An "Emergency" sign 42 is pivotally mounted by hinge 44 (FIG. 5) on casing half 14 in the "Recovery Room" area for movement between a horizontally extended position as shown in FIGS. 2, 4 and 5 and a storage position within a recess 45 (FIG. 5). The back face of the "Emergency" sign 42 carries the indicia "Nursery" (not shown) and directs attention to a shelf (not shown) on the interior of casing half 14 for supporting baby animals.

Figure 3:
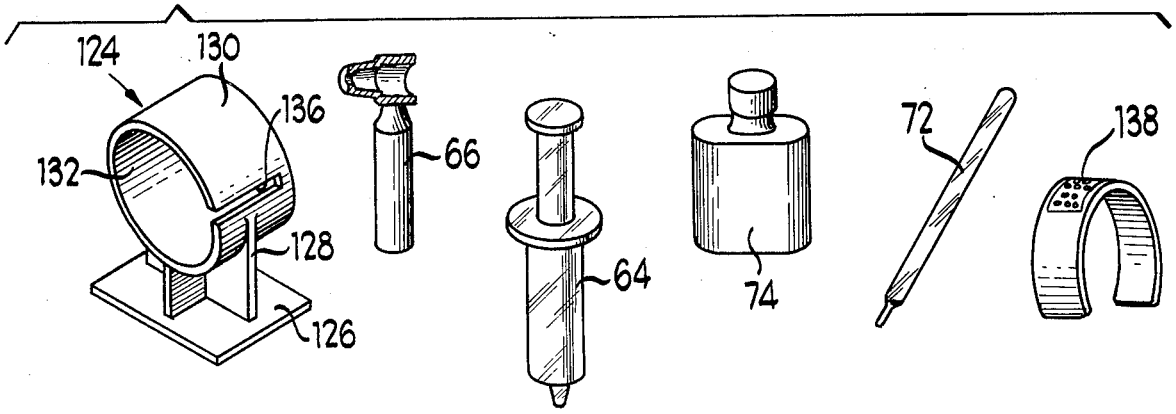
FIG. 3 is an enlarged perspective view of various play items or objects contained within the case of FIGS. 1 and 2.

Casing half 12 includes a horizontally extending compacted W-shaped bar 46 secured to the inner side wall thereof (FIGS. 2, 4 and 5) defining pockets 48 and 50 (FIG. 5) for containing charts, as at 52 (FIG. 2), and a chart clipboard 54, clipboard 54 has an outwardly projecting clip in the form of a U-shaped receiver 56 for releasably holding a pencil 58 by snap or snug fit. Extending outwardly from bar member 46 is a horizontal shelf or table 60 which can be used by the child during play for supporting various instruments during play, e.g., a thermometer 72 (FIGS. 2 and 3).

A shelf and instrument hanger 62 (FIGS. 2 and 4) is secured to and projects from the inner surface of one end wall within shelf half 12 and has a plurality of projecting fingers **62*a* defining slots 62*b* releasably receiving a syringe 64 (FIGS. 2 and 3) and an eye, ear and nose scope 66. Secured to the opposing end wall within casing half 12 is a medicine cabinet 70 (FIGS. 2, 4 and 5) for containing such items as medicine bottle 74 (FIG. 3). Medicine cabinet 70 has a handled door 76 (FIGS. 4 and 5) connected thereto by a hinge 77 so it can be readily opened and closed by a child during play. Beneath cabinet 70 is another instrument hanger (not shown), similar to hanger 62, projecting inwardly from the wall of casing half 12** for hanging toy scissors for use by the child in cutting bandage material and the like.

As seen in FIG. 2, removable bunkbeds 78 and 80 are provided for receiving toy animal patients. The bunkbeds have hook-like end lips **78*a* and 80*a* which are removably received on L-shaped hook-like flanges 82 and 84 (FIGS. 4 and 5) and spacer bars 86 and 88 (FIGS. 2 and 4) extend outwardly from the end wall of casing half 14 to engage the ends of the bunkbeds to maintain the bunkbeds 78 and 80 in a generally horizontal position as seen in FIG. 2**.

The pet or animal patients shown with the hospital set illustrated in FIG. 2 include two toy dogs 100 and 104, a cat 102 and a toy bird 106. Usually the set will include additional toy animals such as a rabbit, a turtle, a couple of baby animals, etc. Of course, a child's own toy animals can be substituted for those shown, as can dolls or other figurines.

Other removable items, each of which can be stored in the case 10, include a wheeled emergency cart 110 (FIG. 2) for use in wheeling toy patients to and from any area of the hospital, e.g. to the "Emergency" portion of casing half 14 and from there to either the "Recovery Room" or the "Treatment Room". An examination or operating table 112 is provided, shown secured on platform 28, for use in the treatment area and can support a toy dog, as at 100, or other pet or figurine. Also shown in FIG. 2, a food tray 114 is provided for use in serving food to a bedridden toy patient. A toy dog's water dish 116 and a dish or plate 118 supporting a simulated bone 120 is shown on the food tray 114 in FIG. 2.

A toy stethoscope 122 (FIG. 2) is provided for use by the child in examining toy patients. A bandage dispenser 124 (FIGS. 2 and 3) also is provided for dispensing bandage material to be applied to the toy animal patients. The bandage dispenser includes a base plate 126 with an upstanding frame 128 supporting a horizontally disposed cylinder 130 having an open end 132 for insertion of a roll of bandage material 134 within cylinder 130. The free end of the roll of bandage material 134 (FIG. 2) protrudes from a slot 136 (FIGS. 2 and 3) so that the roll of bandage material can be unrolled as it is withdrawn by its free end through slot 136. The bandage material 134 is very useful to a child during play and adds realism to play. For example, the dog 104 is shown as it would appear after a child has applied bandage material 134 to it. In addition, a supply of simulated, plastic strip, adhesive bandages is provided in the form of generally U-shaped, resilient, stiff, plastic members as at 138 (FIG. 3) which can be snap or slip fitted onto an appendage of a toy animal.

It will be readily seen that all of the above-described objects or items can be placed and contained within the casing 10 and the partition or platform 28 can be folded upwardly to separate articles in casing half 12 from those in casing half 14. Platform 28 carries table 112 into casing half 12 and can be latched with latch 32 received in latch receiver 34. The casing halves can be closed with latch 24 releasably engaging latch receiver 26.

The animal hospital set of the present invention provides various advantages in the entertainment and amusement of children during play. The set includes equipment with which the child can simulate a number of animal hospital functions. Although specific equipment has been illustrated and described hereinabove, various modifications of the set will be apparent to those having ordinary skill in the art.

We claim:

1. A child's amusement device in the form of a toy hospital set, comprising:

a portable carrying case simulating an ambulance or other emergency vehicle, said case including first and second mating closable casing halves hingedly connected along a line defining vertical mating edges of the casing halves for opening and closing the case;

selectively operable latch means for releasably retaining the case in closed condition; and a partition, pivotally mounted to the bottom of said first casing half for folding downwardly generally along a longitudinal axis from a concealed vertical position dividing the case into two portions when the case is in a closed condition to a horizontal position on a suitable supporting surface when the case is open to provide an outwardly extending platform as well as access to the interiors of the two mating casing halves.

2. The device of claim 1 including handle means pivotally mounted generally at the center of the top mating edge of at least one of said casing halves for facilitating transportation of the case.

3. The device of claim 1 including a plurality of receptacles in each of said casing halves for receiving a plurality of simulated pet hospital implements.

4. The device of claim 3 wherein one of said receptacles comprises a simulated bed protruding from an interior wall of one of said casing halves and a figure toy for positioning thereon.

5. The device of claim 3 wherein plural of said receptacles comprise simulated bunk beds for animated objects, said beds protruding from an interior wall of one of said casing halves.

6. The device of claim 1 including a plurality of veterinarian type accessories sized for positioning within said case.

7. The device of claim 6 wherein at least one of said accessories includes an animal figure toy.

8. The device of claim 6 wherein one of said accessories comprises a simulated ear and nose scope mountable on a flange protruding from an interior wall of one of said casing halves.

9. The device of claim 6 wherein one of said accessories comprises a miniature wheeled "stretcher" sized for positioning on bottom walls of said casing halves when in closed condition.

10. The device of claim 1 including a panel protruding from an interior wall of one of said casing halves having indicia thereon indicating a particular administration room or area within the case and sized so as not to interfere with the closing of the case.

11. The device of claim 1 including a miniature simulated stethoscope sized so as to be positionable within said case when in closed position.

12. The device of claim 1 including a supply of generally U-shaped, simulated, plastic strip, adhesive bandages of a stiff, resilient, plastic material for snap fitting on an animal figure toy animal.

13. The device of claim 1 including indicia means on the interior walls of said casing halves so that when the casing halves are in open position various areas of the interior thereof are designated as particular treatment areas such as "Recovery Room", "Treatment Room", or the like.

14. An animal hospital set, comprising:

a portable carrying case simulating an emergency vehicle including, at least, a generally canted windshield portion, said carrying case including a first and second, closable mating casing half portions;

hinge means secured to the vertical mating edges of the casing halves for securing the casing halves together while permitting opening and closing of the case;

selectively operable latch means for releasably retaining the case in a closed condition;

a movable partition, said partition being pivotally mounted to the bottom of one of said casing halves for folding downwardly generally along a longitudinal axis from a concealed, vertical position, dividing the carrying case into two internal cavities when the case is in the closed condition to a generally planar horizontal position when the casing halves are pivoted about said hinged means to at least a right angle with respect to one another, to provide an outwardly extending platform as well as access to the interiors of the two mating casing halves; and handle means pivotally mounted generally at the center of the top mating edge of one of said casing halves to facilitate transportation of the portable carrying case.

* * * * *